United States Patent [19]

Tajima et al.

[11] Patent Number: 4,532,484

[45] Date of Patent: Jul. 30, 1985

[54] HYBRID COUPLER HAVING INTERLACED COUPLING CONDUCTORS

[75] Inventors: Yusuke Tajima, Acton; Aryeh Platzker, Belmont, both of Mass.

[73] Assignee: Raytheon Company, Lexington, Mass.

[21] Appl. No.: 440,478

[22] Filed: Nov. 9, 1982

[51] Int. Cl.[3] ..... H01P 5/18

[52] U.S. Cl. ..... 333/116; 333/238

[58] Field of Search ..... 333/116, 238, 246

[56] References Cited

U.S. PATENT DOCUMENTS

| | | | |
|---|---|---|---|
| 2,749,519 | 6/1956 | Kostriza et al. | 333/116 |
| 3,512,110 | 5/1970 | Clar | 333/116 |
| 3,562,674 | 2/1971 | Gerst | 333/116 |
| 3,644,850 | 2/1972 | Ho | 333/238 X |
| 4,313,095 | 1/1982 | Jean-Frederic | 333/116 |
| 4,375,053 | 2/1983 | Viola et al. | 333/116 |
| 4,394,629 | 7/1983 | Kumar et al. | 333/116 X |
| 4,394,630 | 7/1983 | Kenyon et al. | 333/116 |

FOREIGN PATENT DOCUMENTS

| | | | |
|---|---|---|---|
| 2723163 | 11/1978 | Fed. Rep. of Germany | 333/238 |
| 1185059 | 3/1970 | United Kingdom . | |

*Primary Examiner*—Paul Gensler

*Attorney, Agent, or Firm*—Denis G. Maloney; Richard M. Sharkansky; Joseph D. Pannone

[57] ABSTRACT

A radio frequency circuit for coupling radio frequency (r.f.) energy between an input port and a pair of output ports with an isolation port being provided for reflected energy. The circuit includes a pair of strip conductors, each one thereof having first surface portions dielectrically spaced a first predetermined distance from a ground plane conductor and second surface portions dielectrically spaced a second different predetermined distance from the ground plane conductor. The first surface portions of one of the pair of strip conductors are electromagnetically coupled, through the dielectric, to the second surface portions of the other one of the pair of strip conductors. In one embodiment, intermediate portions of the pair of strip conductors are interlaced with end portions thereof providing a corresponding one of the aforementioned ports. More particularly, a first plurality of successively spaced strip conductor portions, and a second like plurality of successively spaced strip conductor portions are dielectrically separated from the first plurality of spaced strip conductor portions. Each intermediate one of the first and second plurality of strip conductor portions is connected to a pair of strip conductors flanking the strip conductor portion electromagnetically coupled thereto, to provide a pair of dielectrically separated, interlaced, strip conductors. First and last ones of the first and second plurality of strip conductor portions are coupled to the aforementioned ports. In a second embodiment, end portions of the pair of strip conductors are interlaced and said end portions provide a corresponding one of such aforementioned ports.

21 Claims, 21 Drawing Figures

FIG. 8
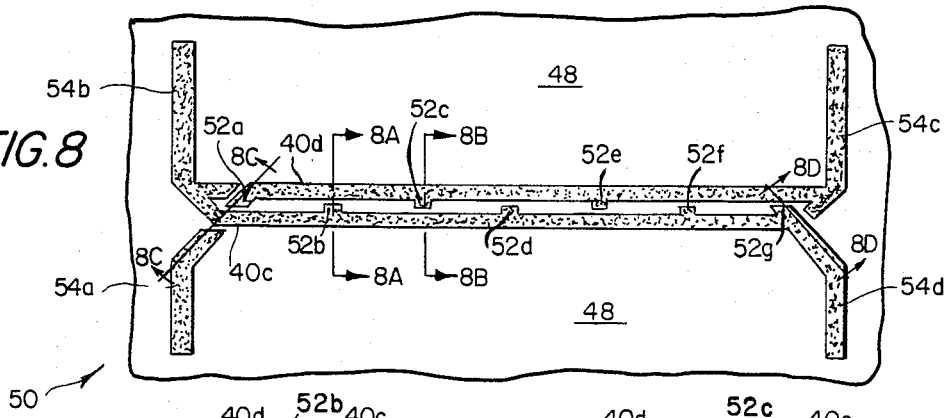
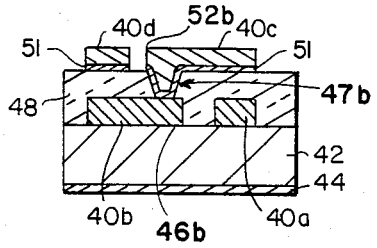
FIG. 8A
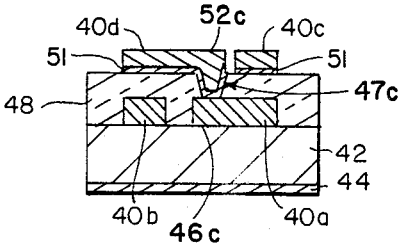
FIG. 8B
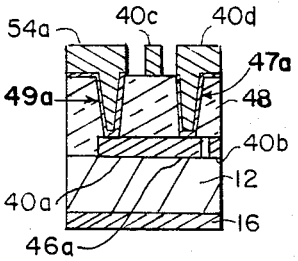
FIG. 8C
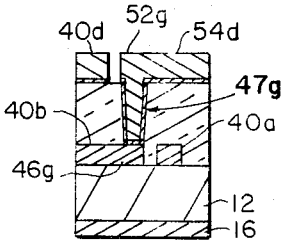
FIG. 8D

HYBRID COUPLER HAVING INTERLACED COUPLING CONDUCTORS

The Government has rights in this invention pursuant to Contract No. F33615-81-C-1413 awarded by the Department of the Air Force.

BACKGROUND OF THE INVENTION

This invention relates generally to radio frequency circuits and more particularly to radio frequency (r.f.) hybrid couplers which combine or divide signals fed thereto among different ports.

As is known in the art, it is often desirable to combine a pair of r.f. signals originating from two devices and deliver such combined r.f. signal to a third device, or alternatively, to split an input r.f. signal from one device and deliver such split components of such r.f. signal to two output devices. One class of couplers includes couplers having radio frequency transmission lines formed on a substrate. In general, one component of such signal is directly coupled between one of a pair of ports and an output port, and a second one of such signals is electromagnetically coupled between a second one of such pair of ports and the output port. An approach used in the prior art to electromagnetically couple a component of such signals has been to couple an electromagnetic field between the edges of a pair of planar, dielectrically spaced strip conductors adjacently formed on a common substrate with end portions of each one of the strip conductors providing a port connection for the coupler. With this prior art approach, the strength of coupling is related to the total area of the edge and the separation between the edges of the strip conductors. As it is also known in the art, the coupler generally provides a characteristic impedance which is compatible with the circuit application of the coupler. Since coupling strength in part is related to total edge area, generally, the total edge area is increased to provide for an increase in coupling strength. One approach used in the prior art to increase the total edge area involves the technique of interdigitating a plurality of narrow strip conductors to thereby increase the total edge area and hence the coupling strength. When designing such couplers, particular attention is given to the characteristic impedance of the coupler since the coupler should provide a characteristic impedance which is compatible with the devices to which it is connected. As is also known in the art, the characteristic impedance of a transmission line, such as a microstrip transmission line, is related to substrate thickness, dielectric constant, and conductor width. Thus, the width, spacing and number of such interdigitated strip conductors are generally selected to provide the coupler with the desired coupling factor and predetermined characteristic impedance. That is, the width and number of such narrow strip conductors and their spacing are generally selected to be sufficiently narrow to provide a coupler with a desired coupling factor, and the width and number of such narrow strip conductors are likewise chosen to provide the coupler with the predetermined characteristic impedance. One problem associated with such a structure is that, as increased coupling strength is required, the conductor widths and spacing therebetween decrease providing a difficult circuit to fabricate with acceptable yields in order to achieve the desired coupling strength and to maintain the predetermined characteristic impedance. Also, as the conductor width decreases, conductor resistivity increases and hence conductor losses and therefor coupler insertion loss increases.

SUMMARY OF THE INVENTION

In accordance with the present invention, a radio frequency circuit for coupling an r.f. signal between an input port and a pair of output ports with any reflected power being coupled to an isolated port, includes a pair of strip conductors dielectrically spaced from a ground plane conductor. Each strip conductor has portions disposed in two different planes. Each end of each dielectrically spaced strip conductor provides a corresponding one of such ports. With such an arrangement, a coupler is provided for coupling signals between an input port and a pair of output ports by directly feeding a first component of such signal from the input port to a first one of the pair of ports, and by electromagnetically coupling a second component of such signal between adjacent top and bottom surfaces of such transmission lines coupled between the input port and a second one of such pair of ports. By electromagnetically coupling a signal between adjacent top and bottom surfaces of such transmission lines, an increase in the coupling surface area is provided, providing increased coupling strength without the increase in insertion loss generally associated with prior art structures. Further, such a structure is easier to fabricate than the closely spaced thin conductors generally associated with interdigitated couplers.

In accordance with one embodiment of the invention, the coupler includes a first plurality of successively spaced strip conductor portions disposed a first predetermined distance from a ground plane conductor, and a second like plurality of strip conductor portions disposed a second different predetermined distance from the ground plane conductor dielectrically spaced from the first plurality of strip conductor portions. A surface of each one of the first strip conductor portions is electromagnetically coupled to a surface of a corresponding one of the second strip conductor portions. Each intermediate one of the first and second strip conductor portions is connected to a pair of strip conductor portions flanking the strip conductor portion electromagnetically coupled thereto, to provide a pair of dielectrically separated interlaced strip conductors. With such an arrangement, a symmetric coupler is provided since each strip conductor may be disposed at the same average distance from the ground plane conductor by disposing portions of each strip conductor at a first distance and second portions of each strip conductor at a second distance. Thus, each strip conductor in combination with the dielectric and the ground plane provides a pair of transmission lines having substantially the same electromagnetic characteristics. Further, since a surface of each one of the strip conductor portions is electromagnetically coupled to a surface of a second one of the strip conductor portions, the coupling therebetween is stronger than prior art techniques.

In accordance with an alternate embodiment of the present invention, a coupler circuit includes a first pair of dielectrically spaced planar strip conductors and a second pair of dielectrically spaced planar strip conductors, dielectrically spaced in a different plane from the first pair, and with each strip conductor of the second pair aligned over a corresponding strip conductor of the first pair and electromagnetically coupled thereto. Each strip conductor of the first pair is alternatively connected to the one strip conductor of such dielectrically spaced conductors of the second pair not electromagnetically coupled thereto, at a plurality of locations along the length of such lines. With such an arrangement, a coupler having a high degree of coupling strength is provided. Further, the propagation of a signal through the transmission lines provided in combination with each of such strip conductor lines is relatively uniform since a first portion of the signal will propagate between the input port and each one of the pair of output ports along a first transmission line having a strip conductor formed on the substrate, and a second portion of the signal will propagate along a second transmission line having a strip conductor formed on the dielectric layer. Further, such connections of diagonally spaced non-electromagnetically coupled ones of such strip conductors of the transmission line will provide equal potential excitation of energy propagating along the transmission lines.

BRIEF DESCRIPTION OF THE DRAWINGS

The foregoing features of this invention, as well as the invention itself, may be more fully understood from the detailed description read together with the accompanying drawings, in which:

FIGS. 6–8 are a series of plan views showing steps in the construction of an alternate embodiment of the invention.

FIGS. 8A–8D are cross-sectional views taken along lines 8A—8A, 8B—8B, 8C—8C and 8D—8D of FIG. 8 showing certain details of construction.

DESCRIPTION OF THE PREFERRED EMBODIMENTS

Figure 1:
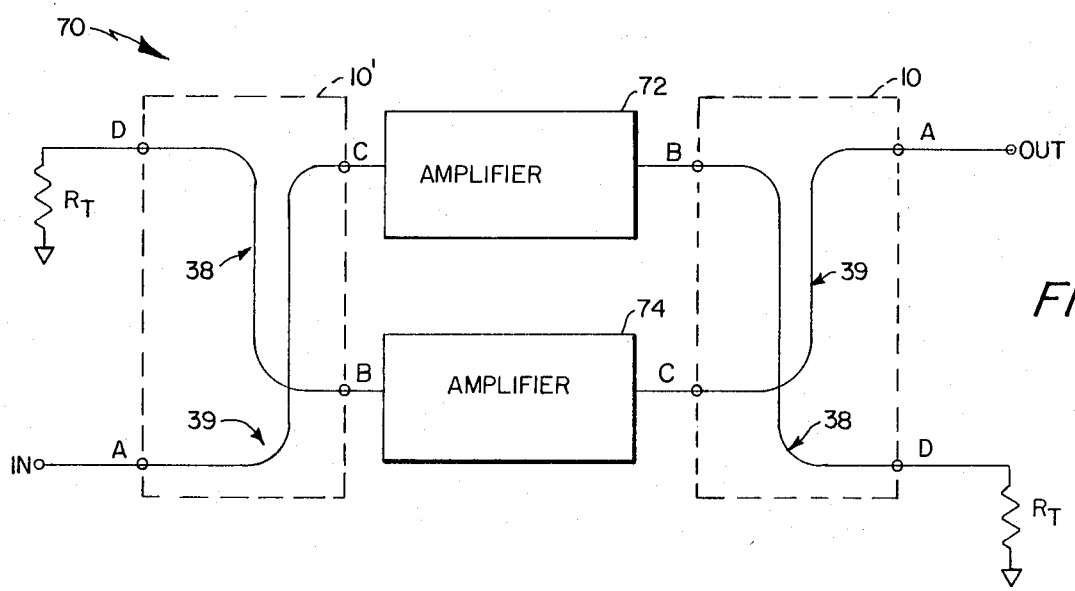
FIG. 1 is a block diagram of a double balanced amplifier using hybrid couplers in accordance with the invention.

A hybrid quadrature coupler 10 (FIG. 3) for coupling a radio frequency (r.f.) signal between an input port and a pair of output ports with an isolated port being provided for any reflected r.f. signal from such ports will initially be described in conjunction with FIGS. 1–4. Referring first to FIG. 1, a double balanced amplifier 70 is shown to include a first hybrid coupler 10' here configured as a signal divider, a pair of conventional match amplifiers 72, 74, and the second hybrid coupler 10 here configured as a signal combiner connected together, as shown.

Figure 2:
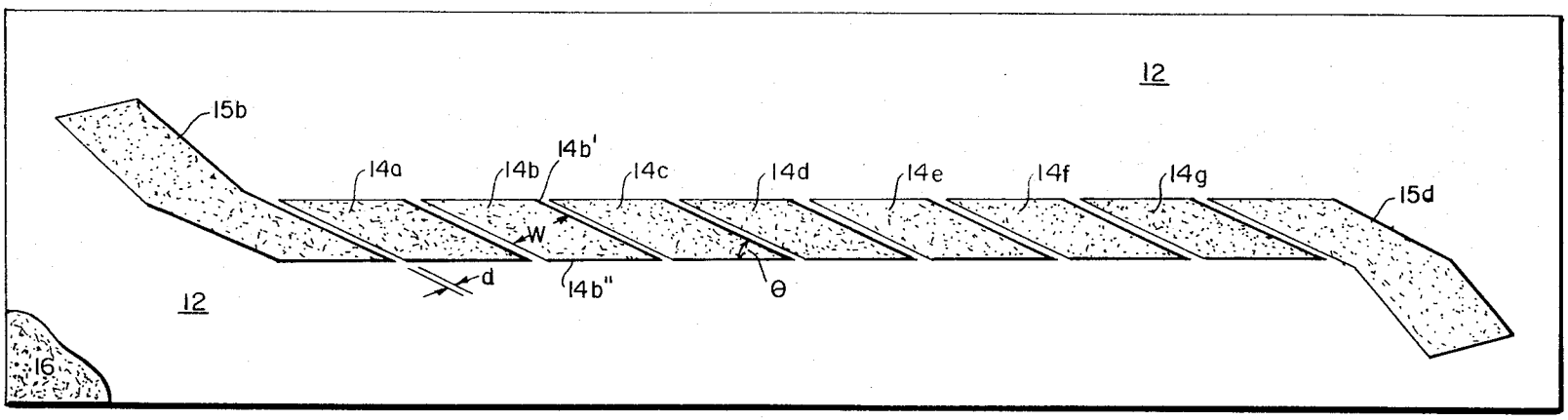
FIGS. 2–4 are a series of plan views showing steps in the construction of a radio frequency circuit in accordance with the invention.

Referring now to FIG. 2, a plurality of segmented strip conductor portions **14*a*–14*g* are shown formed on a first surface of a dielectric substrate 12 here semi-insulating gallium arsenide (GaAs) having an initial thickness of 15 mils. Such strip conductor portions 14*a*–14*g*, (here a conventional metallization system including a first layer of titanium and a second layer of gold) are formed using conventional photolithographic masking and metal evaporating techniques. The strip conductor portions 14*a*–14*g* are here evaporated to a thickness of approximately 1 $\mu$m and have a width w of here 50 $\mu$m. The dielectric substrate 12 has formed on a second surface opposite such first surface a ground plane conductor 16. The ground plane conductor 16 is formed on the substrate 12 after the substrate 12 is thinned to a predetermined thickness, here 4 mils. Each one of such strip conductor portions 14*a*–14*g* here an odd number of segments are spaced from one another by a distance d here approximately 15 $\mu$m. Each strip conductor portion 14*a*–14*g* is here approximately shaped as a parallelogram having an acute vertex angle $\theta$ between a slanted side 14*b'* of the segment 14*b* for example, and a horizontal side 14*b''* thereof which is selected to be in the range of 0° to 90°. Here the acute vertex angle $\theta$ is chosen to be approximately 15°. A pair of strip conductor portions 15*b* and 15*d* are formed on the substrate 12 adjacent strip conductor portions 14*a* and 14*g*, respectively, as shown. Such strip conductor portions 15*b*, 15*d* are here used to provide a conductive contact for strip conductors (FIG. 4) to two of such aforementioned ports, here ports B and D (FIG. 4). The length of each horizontal side of such strip conductor portions 14*a*–14*g*, the number of such portions 14*a*–14*g*** and the spacing (d) therebetween are chosen to provide in combination a length here substantially equal to a quarter wavelength $\lambda/4$ where $\lambda$ is the wavelength of the corresponding centerband operating frequency of the circuit.

Figure 3A:
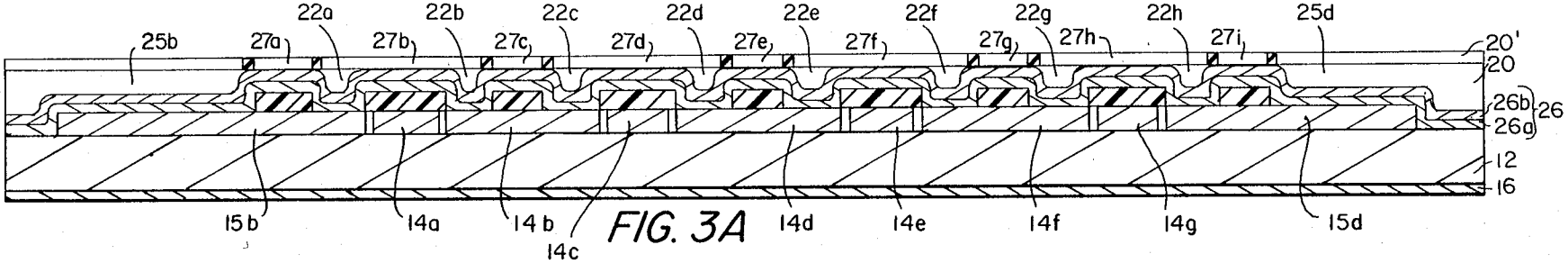
FIG. 3A is a cross-sectional view of FIG. 3 taken along line 3A—3A.
Figure 3:
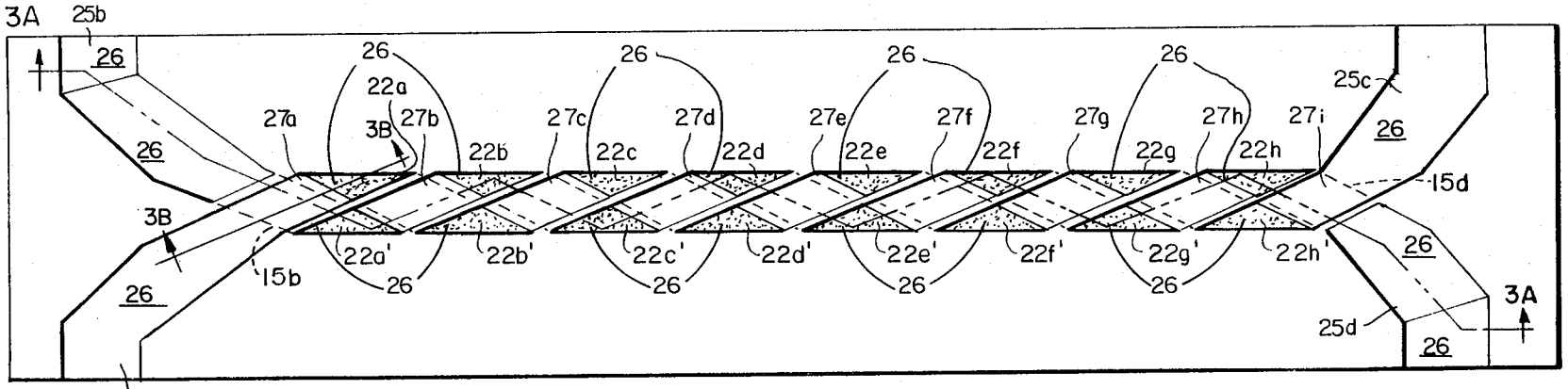
Figure 5B:
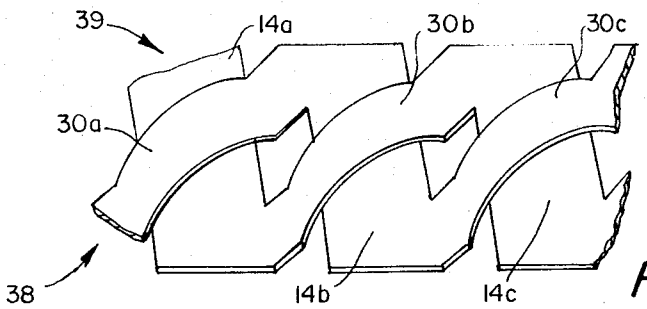
FIG. 5B is a diagrammatical, isometric view of FIG. 5A.
Figure 3B:
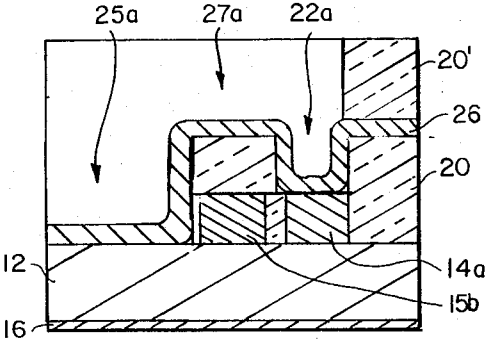
FIG. 3B is a cross-sectional view of FIG. 3 taken along line 3B—3B showing masking steps used to provide an air bridge.

Referring now to FIGS. 3, 3A and 3B, a first masking layer 20, here of photoresist is provided over the strip conductor portions **14*a*–14*g* and substrate 12, as shown. Using conventional masking and etching techniques, a plurality of here triangularly shaped apertures 22*a* to 22*h* and 22*a'* to 22*h'* are formed in such masking layer 20, aligned with and exposing selective underlying portions of the strip conductor portions 14*a*–14*g* and portions of the strip conductor 15*b*, 15*d*. Apertures 22*a*–22*h*, 22*a'*–22*h'* are here provided to form plating holes through the masking layer 20 to selectively interconnect the strip conductor portions 14*a*–14*g* in a manner to be described. A second plurality of apertures 25*a*–25*d* are provided in the masking layer 20, exposing selective underlying portions of the substrate 12 and underlying portions of the strip conductors 15*b*, 15*d*. As shown in FIG. 3B, a portion of layer 20 is provided over strip conductor 15*b* so that when a strip conductor is formed in aperture 25*a*, said strip conductor will bridge strip conductor 15*b*. Apertures 25*a*–25*d* are formed in the masking layer 20 to define an area where strip conductors for ports A-D of the coupler will be provided, in a manner to be described in conjunction with FIG. 4. For example, apertures 25*b* and 25*d* which selectively expose a portion of the substrate 12 and the strip conductor portion 15*b*, 15*d* (FIG. 3A) respectively provide areas where the port B, and port D strip conductors (FIG. 4) are formed to couple such strip conductors (FIG. 4) to segments 14***b*, 14*f* (FIG. 3A). Upon masking layer 20 is provided a layer 26*a* of here evaporated titanium 600 A thick and a layer 26*b* of evaporated gold 2000 A thick forming in combination a composite layer 26. A second layer 20' of photoresist is deposited on composite layer 26 and is patterned in the same areas as the first layer 20 of photoresist, and is patterned to provide a third plurality of apertures 27*a*–27*i* in masking layer 20' for plating strip conductor portions now to be described.

Figure 4A:
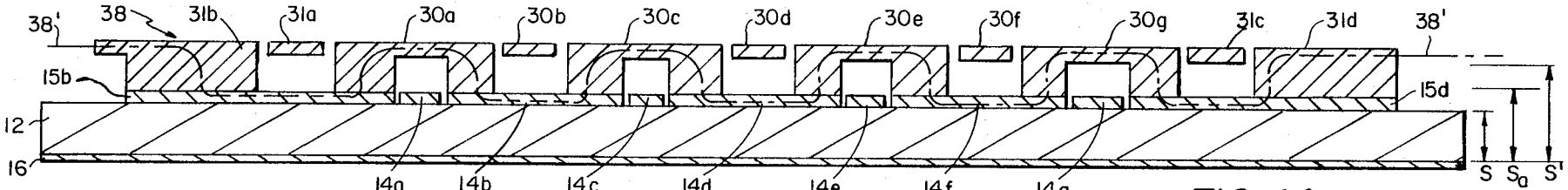
FIG. 4A is a cross-sectional view of FIG. 4 taken along line 4A—4A showing in cross section a first one of a pair of twisted strip conductors.
Figure 4:
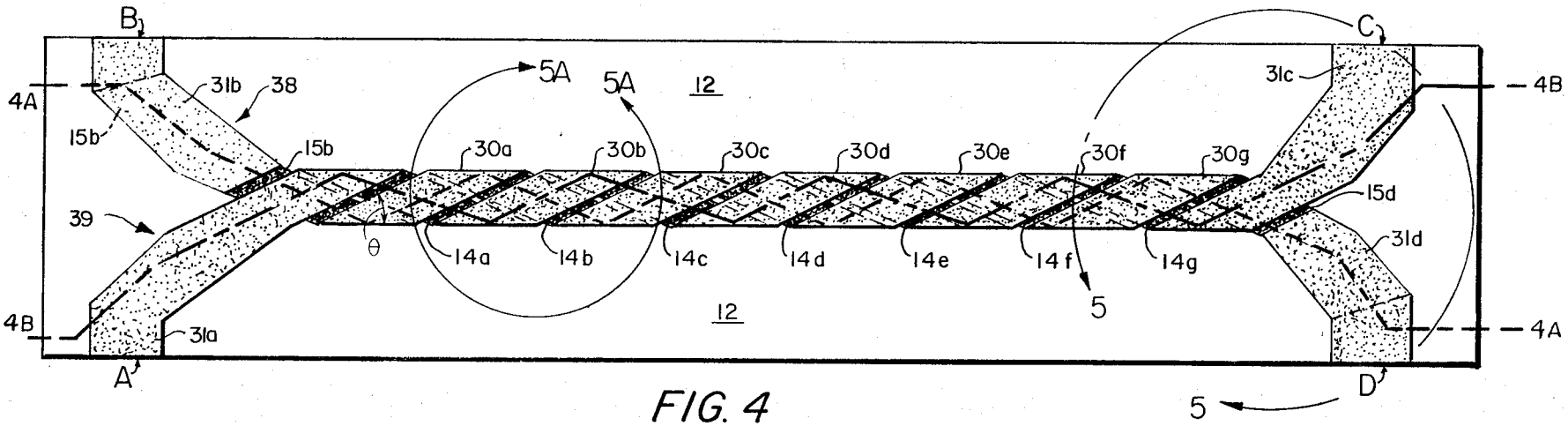
Figure 4B:
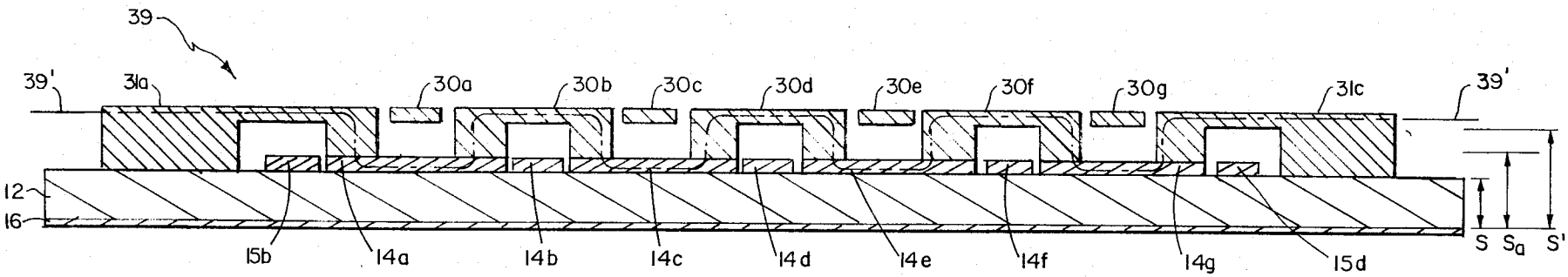
FIG. 4B is a cross-sectional view of FIG. 4 taken along line 4B—4B showing in cross section a second one of a pair of twisted strip conductors.
Figure 5A:
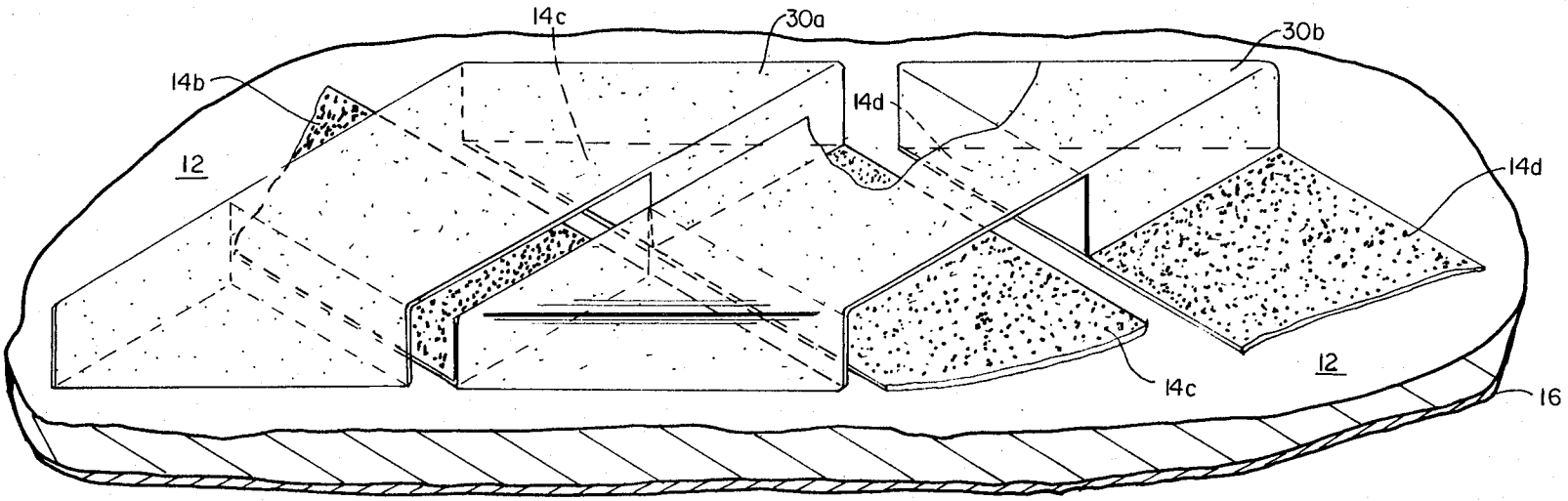
FIG. 5A is an isometric, partially broken away view taken along line 5A—5A of the circuit shown in FIG. 4.
Figure 5:
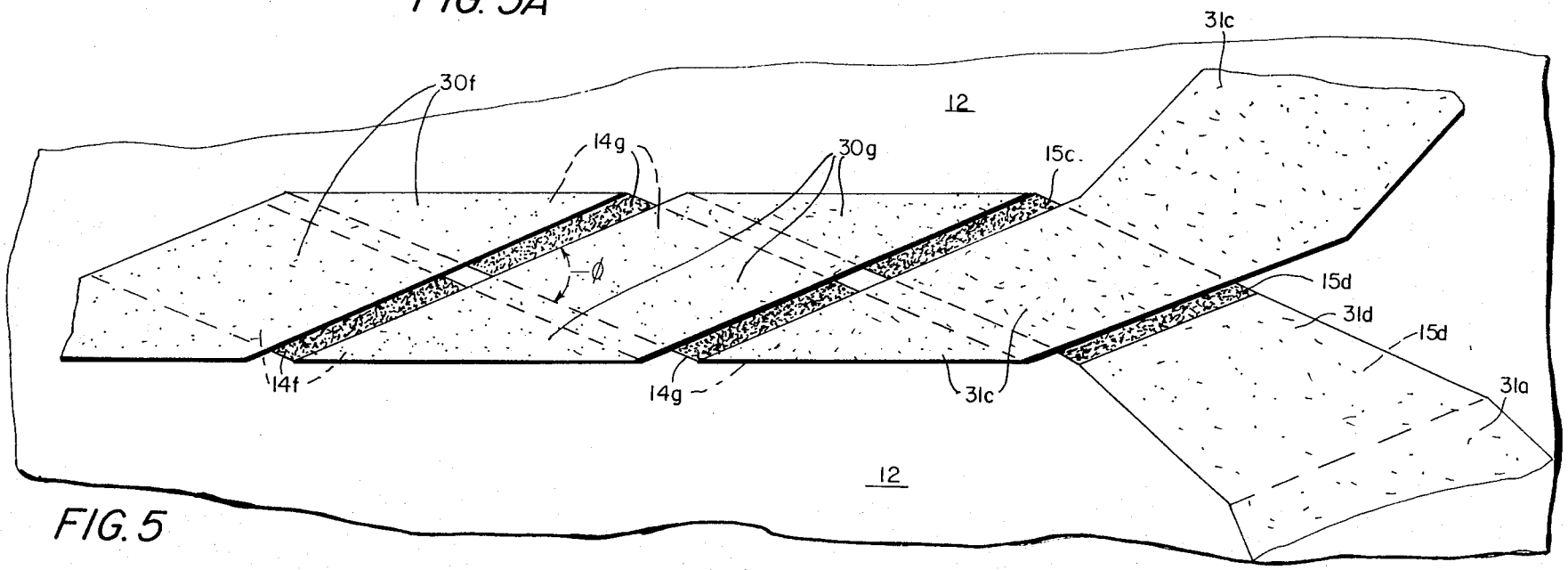
FIG. 5 is a plan view taken along line 5—5 of the circuit shown in FIG. 4.

Referring now to FIGS. 4, 4A and 4B, a second like plurality of successively spaced strip conductor portions 30*a*–30*g* is formed in the masking layer 20, through apertures 27*a*–27*g* (FIG. 3) and plated on composite layer 26 (not shown) to a thickness of 3 μm. Strip conductor portions 30*a*–30*g* are formed dielectrically spaced from and in alignment with strip conductor portions 14*a*–14*g*, such that each one of such first strip conductor portions 14*a*–14*g* is electromagnetically coupled to a corresponding one of such second plurality of strip conductor portions 30*a*–30*g*. Further, strip conductor portions 30*a*–30*g* are formed in a criss-cross relation with strip conductor portions 14*a*–14*g* (FIG. 2), as shown. Strip conductor portions 30*a*–30*g* here are shaped as parallelograms having acute vertex angles of $\theta \sim 15°$, as previously described. Segments 30*a*–30*g* are also formed in masking layer 20 aligned with apertures 22*a*–22*h*, 22*a'*–22*h'* so that when formed the strip conductor portions 30*a*–30*g* are selectively connected with selected strip conductor portions 14*a*–14*g* formed under the masking layer 20. Thus, selective interconnection of portions 30*a*–30*g* with corresponding ones of segments 14*a*–14*g* provide in combination a pair of interlaced, twisted or interwoven strip conductors 38, 39. Such transmission lines 38, 39 are formed by interconnecting such strip conductor portions 14*a*–14*g* and 30*a*–30*g* so that strip conductor portions 30*a*–30*g* provide air bridges over selected ones of strip conductor portions 14*a*–14*g*. Such air bridges or overlays are provided by plating such top strip conductor portions 30*a*–30*g* in the apertures 22*a*–22*h*, 22*a'*–22*h'* (FIG. 3). Each intermediate one of each first and second plurality of strip conductor portions 30*a*–30*g* is connected by the air bridges formed therefrom to a pair of strip conductor portions 14*a*–14*g* flanking the one of the strip conductor portions 14*a*–14*g* electromagnetically coupled thereto.

Therefore, transmission line 38 shown in cross section in FIG. 4A here includes the ground plane 16, substrate 12 and a composite strip conductor 38' denoted by arrow 38'. Composite strip conductor 38' includes strip conductor portions 31*b* and 15*b* connected together, as shown. The composite strip conductor 38' further includes strip conductor portion 15*b* connected to strip conductor portion 30*a* which dielectrically bridges strip conductor portion 14*a*, as shown. The composite strip conductor 38' further includes strip conductor portion 14*b* connected between strip conductor portion 30*c* and 30*a* with strip conductor portion 30*c* dielectrically bridging strip conductor 14*c*. The composite strip conductor 38' further includes strip conductor 14*d* connected between strip conductor portion 30*c* and strip conductor portion 30*e* with strip conductor portion 30*e* dielectrically bridging strip conductor portion 14*e*, strip conductor portion 14*f* connected between strip conductor portion 30*e* and strip conductor portion 30*g* with strip conductor portion 30*g* dielectrically bridging strip conductor portion 14*g*, and strip conductor portions 15*d* and 31*d* connected together, as shown.

Further, transmission line 39 shown in cross section in FIG. 4B here includes the ground plane 16, substrate 12 and a composite strip conductor 39' denoted by arrow 39'. Composite strip conductor 39' includes strip conductor portions 31*a* and 14*a*, connected together, as shown. The composite strip conductor 39' further includes strip conductor portion 14*a* connected to strip conductor portion 30*b* which electrically bridges strip conductor portion 14*b*, as shown. The composite strip conductor 39' further includes strip conductor portion 14*c* connected between strip conductor portion 30*b* and strip conductor portion 30*d* with strip conductor portion 30*d* dielectrically bridging strip conductor 14*d*. The composite strip conductor 39' further includes strip conductor portion 14*e* connected between strip conductor portion 30*d* and strip conductor portion 30*f* with strip conductor portion 30*f* dielectrically bridging strip conductor portion 14*f*, and strip conductor portion 14*g* connected between strip conductor portion 30*f* and strip conductor portion 31*c*, with strip conductor portion 31*c* dielectrically bridging strip conductor portion 15*d*.

Unlike prior art structures, where a relatively small edge area of a strip conductor is used to couple radio frequency energy to a second strip conductor along an adjacent edge thereof, here the relatively wide top and bottom surfaces W of the strip conductor portions 14*a*–14*g*, 30*a*–30*g* are used to couple energy between composite strip conductors 38', 39'. Since the coupling between top and bottom surfaces is stronger than the conventional edge coupling technique, a coupler may be fabricated having relatively wider strip conductors than the strip conductors used in interdigitated couplers, and thus have reduced insertion loss.

The transmission lines are here formed in a "twisted", cork screw, or interlaced configuration in order to provide a symmetric coupler wherein each transmission line is provided with substantially the same characteristic impedance. Thus, each composite strip conductor 38', 39' has portions formed in one of two planes. Since, as shown in FIGS. 4A, 4B, each bottom strip conductor portion 14*a*–14*g* is spaced a distance S from the ground plane 16, and each top strip conductor portion is spaced a distance S' from the ground plane 16, each composite strip conductor 38', 39' is spaced an average distance $S_a$ from the ground plane 16. Thus, each composite strip conductor 38', 39' provides in combination with the substrate 12 and ground plane 16 a pair of transmission lines having substantially the same electromagnetic characteristics. Thus, the coupler is here a symmetric coupler since each one of such lines has substantially the same electrical characteristics.

Referring now to FIGS. 1, 5, 5A, 5B, the coupling circuit 10 can be used to combine a pair of radio frequency (r.f.) signals fed from here a pair of amplifiers 72, 74 to a pair of ports B, C of the coupler 10 (FIG. 1) and deliver such r.f. signals to an output port A of the coupler 10 (FIG. 1) to a third amplifier (not shown) with the combined components of such r.f. signal being 90° out of phase with respect to each other. When used as a combiner 10, a pair of r.f. signals are fed to input ports B and C with the combined r.f. signal from such ports being fed to an output port here port A, and with no r.f. signal being fed to port D. When used as a combiner, the r.f. signal incident on ports B and C is coupled to port A, as follows: an r.f. signal fed to port C is coupled directly to port A since they are directly connected together, via braided transmission line 39 (FIG.

4) and such signal is shifted in phase by −90° since the length of such braided transmission line is chosen to have a length substantially equal to a quarter of a wavelength (λ/4) where λ is the corresponding wavelength of the midband frequency of the r.f. signal to be coupled. An r.f. signal fed to port B is electromagnetically coupled to port A at air bridge portions of strip conductor portion 30a–30g (regions where the braided transmission lines 38, 39 cross each other), as diagrammatically shown in FIG. 5B. At such air bridge or crossover portions of strip conductor portion 30a–30g, the electromagnetic wave propagating down twisted transmission line 38 from port B, towards the isolated port D, will couple onto the twisted transmission line 39 and propagate on transmission line 39 in a direction opposite from the propagation direction on twisted transmission line 38, and such energy thus will be shifted in phase by −180°. Hence the coupled energy from port B will propagate toward port A with a phase shift of −180°. Thus, the signal delivered at port A will be the vector combination of the signals fed from port B and port C and hence, the signals are combined at port A with a 90° phase shift between the incident input signals. For equal incident signals on port B and port C, any reflected portion of the signals from port A will be coupled to port D, and no reflected portion of the signal will propagate towards port B or port C. As shown in FIG. 1, port D is terminated in an impedance equal to the characteristic impedance of the transmission lines 38, 39, here 50 ohms. Alternatively, the microwave circuit can be used as a signal divider 10' (FIG. 1) when a signal is fed to port A, for example, such signal is divided between port B and port C in a similar manner as explained above. In such a situation, the signal incident at port A is divided between ports B and C in quadrature, that is, such components of signals at ports B and C are shifted in phase by 90°.

In accordance with the invention, the strength of the coupling of the electromagnetic energy propagating on one of such twisted transmission lines and coupled to the second one of such twisted transmission lines 38, 39 can be selected, by selectively varying the surface area of each segment 14a–14g, and 30a–30g to control the effective coupling surface area, or the portions of the surface areas of each of such conductors crossing over a corresponding one of such conductors, and by varying the vertex angle of each of the segments between 0° and 90° and thus varying the angle $\phi$ (FIG. 5) at which the segments 14a–14g, 30a–30g cross each other, with maximum coupling occuring at $\phi$ approaches 0° and minimum coupling occuring at $\phi$ approaches 90°. Further, by providing an odd number of segments, the microwave circuit 10 is configured such that the output port A is located on the same side of the coupler as the isolated port D.

Alternatively, the strip conductor portions 14a–14g may be spaced from the bridging strip conductor portions 30a–30g by a layer of a dielectric material such as silicon nitride, polyimide, or other suitable material. Further, a combination of air and dielectric material may be used to dielectrically space the strip conductor portions 14a–14g, 30a–30g to provide selected electromagnetic characteristics.

Alternatively, the output port A of a coupler may be provided on the same side of the coupler as one of the input ports, here port (C). In such a case, by providing an even number of segments, the output port A will be on the same side of the coupler 10 as input port C since such ports are here directly connected together by transmission line 39 and by adding an additional segment, for example, to each line, the composite or twisted strip conductors 38', 39' cross each other an additional time, changing the position of the terminal end portions of such lines on the substrate, and hence the location of ports D and B.

Figure 6:
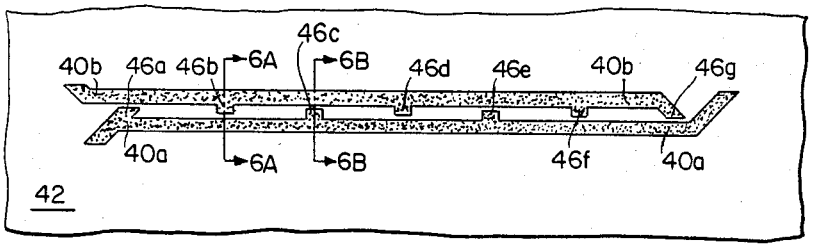
Figure 6A:
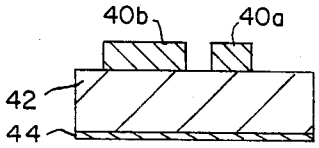
FIGS. 6A, 6B and 7A, 7B are cross-sectional views taken along lines 6A—6A, 6B—6B, 7A—7A and 7B—7B of FIGS. 6 and 7 respectively.
Figure 6B:
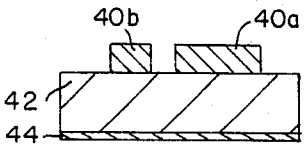
Figure 7:
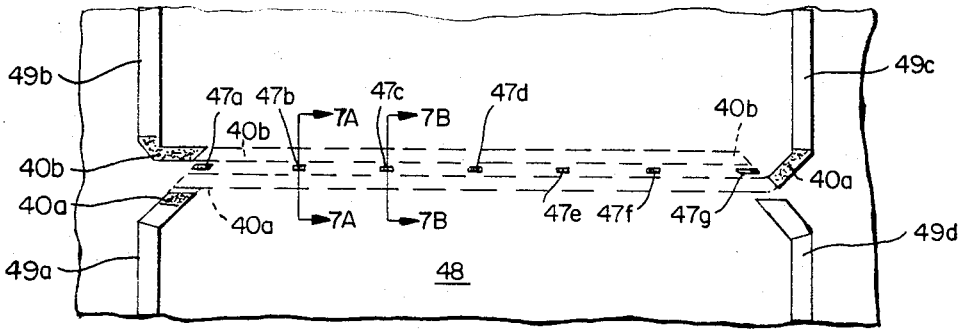
Figure 7A:
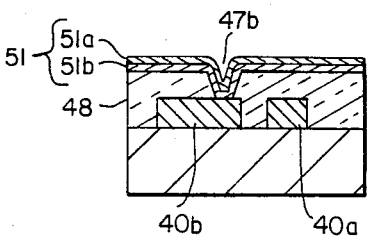
Figure 7B:
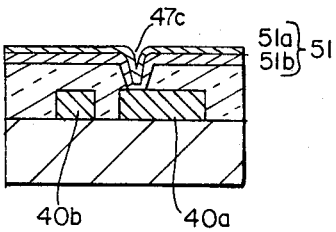

Referring now to FIGS. 6–8, an alternate embodiment of the invention is shown. Referring first to FIG. 6, a substrate 42 has formed on a first surface thereof a pair of here spaced parallel strip conductors 40a, 40b, and a ground plane 44 formed on a second surface of the substrate 42 opposite the first. Integrally formed with each strip conductor 40a, 40b are a plurality of bonding pads 46a–46g, respectively. Strip conductors 40a, 40b and bonding pads 46a–46g are patterned on the substrate 42 using conventional masking and evaporation techniques. Strip conductors 40a, 40b and bonding pads 46a–46g are here a composite layer of titanium and gold, with gold evaporated to a thickness of 1 μm.

Referring now to FIG. 7, a dielectric layer 48, here of polyimide is deposited on the strip conductor surface of the substrate 42. Using conventional masking and etching techniques, the dielectric layer is patterned to provide a plurality of apertures 47a–47g in alignment with portions of corresponding ones of such bonding pads 46a–46g. Apertures 47a–47g are provided through the dielectric layer 48 to expose selective end portions of such bonding pads 46a–46g. A second plurality of apertures 49a–49d are provided through the dielectric layer 48. A layer 51a of titanium and a layer 51b of gold are deposited to form a composite layer 51 as previously described for composite layer 26 (FIG. 3). Apertures 49a–49d are here used for forming of strip conductors 52a–52d (FIG. 8) therein, such strip conductors 52a–52d being provided to interconnect the coupler (FIG. 8) to external components. Suffice it here to say, that, such apertures 47a–47g, 49a–49d provide plating holes for interconnection to such strip conductors 40a, 40b of a second pair of strip conductors.

Referring now to FIG. 8, a coupler 50 is shown to further include a second pair of spaced parallel strip conductors 40c, 40d formed on the dielectric layer 48 and here aligned with the corresponding strip conductors 40a, 40b previously formed on the substrate thereunder. Integrally formed with each strip conductor 40c, 40d is a plurality of bonding pads 52a–52g. Each bonding pad 52a–52g is formed aligned with a corresponding aperture 47a–47g which were previously formed in alignment with corresponding ones of the bonding pads 46a–46g integrally formed with strip conductors 40a, 40b. As shown in FIGS. 8A–8B, each strip conductor 40a–40d and associated bonding pad thereof is aligned such that diagonally spaced pairs 40a, 40d and 40b, 40c of such strip conductors 40a–40d are alternately connected together by plating the corresponding top bonding pad 52a–52g. through the corresponding aperture 47a–47g (FIG. 7) to connect to the portion of the corresponding bonding pad 46a–46g (FIG. 6) of the corresponding bottom strip conductors 40a, 40b exposed by such apertures 47a–47g. Thus, as shown in FIG. 8A, strip conductor 40b is shown coupled to strip conductor 40c, via plating hole 47b and bonding pads 46b, 52b. In a similar manner, the next interconnection of strip conductor lines 40a–40d as shown in FIG. 8B has strip conductor 40a coupled to strip conductor 40d, via plating hole 47c and bonding pads 46c, 52c. Successive ones of such pairs of diagonally spaced conductors 40*a*, 40*d*, 40*b*, 40*c* are interconnected in a similar manner.

Port strip conductors 54*a*–54*d* are where formed in apertures 49*a*–49*b*, respectively. Port strip conductor 54*a* is formed in aperture 49*a* (FIG. 7) which selectively exposes an end portion of strip conductor 40*a* and the substrate 42. Thus, port strip conductor 54*a* is plated through aperture 49*a* to provide a direct connection to strip conductor 40*a*. Also, port strip conductor 54*a* is connected with strip conductor 40*d* (FIG. 8C) by plating bonding pad 52*a* through aperture 47*a* to bonding pad 46*a*. Port strip conductor 54*c* is formed in aperture 49*c* (FIG. 7) which selectively exposes an end portion of strip conductor 40*a* and the substrate 42. Thus, port strip conductor 54*c* is plated through aperture 49*c* to provide a direct connection to strip conductor 40*a*. Also, port strip conductor 54*c* is integrally formed with strip conductor 40*d*. Thus, port strip conductors 54*a* and 54*c* and hence ports A and C are directly connected together, via strip conductors 40*a* and 40*d*.

In a similar manner, port strip conductor 54*b* is formed in aperture 49*b* (FIG. 7) which selectively exposes an end portion of strip conductor 40*b* and the substrate 42. Thus, port strip conductor 54*b* is plated through aperture 49*b* to provide a direct connection to strip conductor 40*b*. Also, port strip conductor 54*b* is integrally formed with strip conductor 40*c* and strip conductor 40*c* here bridges over an underlying portion of strip conductor 40*a*. Port strip conductor 54*d* is formed in aperture 49*d* (FIG. 7) which selectively exposes a portion of the substrate 42. Strip conductor portion 54*d* here bridges over underlying strip conductor 40*a* and is directly connected to strip conductor 40*b* by plating bonding pad 52*g* (FIG. 8D) through aperture 47*g* (FIG. 7) to bonding pad 46*g* (FIG. 6). Also, port strip conductor 54*d* is integrally formed with strip conductor 40*c*. Thus, port strip conductors 54*b* and 54*d* and hence ports B and D are directly connected together via strip conductors 40*b* and 40*c*.

In operation, a signal is coupled between port A, and ports B and C, for example, in a similar manner, as was described. Further, a symmetric structure is here provided by having a first portion of such signal propagate along a top conductor, here one of strip conductors 40*c*, 40*d* and a second, portion propagating along a bottom conductor, here one of strip conductors 40*a*, 40*b*. The alternate connection of diagonally spaced pairs of such strip conductors, as previously described, is provided to insure an equal potential excitation of the electromagnetic wave which propagates along such conductors in response to a signal fed to such lines. Further, such alternately coupled pairs suppress parasitic transmission modes since the effects of the different dielectric constants of the substrate 42, dielectric layer 48 and air are suppressed by periodically connecting such diagonally spaced lines together to provide a balanced configuration along such lines 40*a*–40*d*.

Having described preferred embodiments of the invention, it will now be apparent to one of skill in the art that other embodiments incorporating its concept may be used. It is felt, therefore, that this invention should not be restricted to the disclosed embodiments, but rather should be limited only by the spirit and scope of the appended claims.

What is claimed is:

1. A radio frequency circuit comprising:

a ground plane conductor;

a pair of strip conductors, each strip conductor having first lower surface portions spaced a first predetermined distance from said ground plane conductor, and second lower surface portions spaced a second different predetermined distance from said ground plane conductor, with the first lower surface portions of one of the strip conductors being electromagnetically coupled to corresponding surface portions of the second one of the strip conductors.

2. The radio frequency circuit as recited in claim 1 further comprising means for supporting the second lower surrface portions of each one of the pair of strip conductors.

3. The radio frequency circuit as recited in claim 1 wherein end portions of each one of such strip conductors are interlaced.

4. The radio frequency circuit as recited in claim 1 wherein intermediate portions of each one of such strip conductors are interlaced.

5. The radio frequency circuit as recited in claim 2 wherein end portions of each one of such strip conductors are interlaced.

6. The radio frequency circuit as recited in claim 2 wherein intermediate portions of each one of such strip conductors are interlaced.

7. A radio frequency circuit comprising:

a first plurality of successive, dielectrically spaced strip conductor segments;

a second like plurality of successive, dielectrically spaced strip conductor segments; and wherein a first one of upper and lower surfaces portions of each one of the first plurality of successively spaced strip conductor segments is electromagnetically coupled to an opposite one of upper and lower surface portions of a corresponding one of the second plurality of spaced strip conductor segments.

8. The radio frequency circuit as recited in claim 7 wherein the surfaces of each of the plurality of strip conductor portions are electromagnetically coupled through a dielectric medium.

9. A radio frequency circuit comprising:

a substrate;

a ground plane conductor disposed on a first surface of said substrate;

a first plurality of successively spaced strip conductor segments disposed substantially in a first plane over a second surface of said substrate;

a second like plurality of successively spaced strip conductor segments disposed substantially in a second, different plane over said second surface of said substrate, with each one of said second plurality of segments being electromagnetically coupled to a corresponding one of said first plurality of segments; and means for interconnecting each one of intermediate ones of the second plurality of segments to a corresponding pair of the first plurality of segments, said pair of segments being disposed on either flank of the corresponding one of the first plurality of segments electromagnetically coupled to the one of said intermediate ones of said second plurality of segments.

10. The radio frequency circuit as recited in claim 9 wherein central surface portions of each one of the first plurality of successively spaced strip conductor segments is electromagnetically coupled to central surface portions of the corresponding one of the second plurality of spaced strip conductor segments.

11. The radio frequency circuit as recited in claim 10 wherein the electromagnetically coupled surfaces of each of the plurality of strip conductor portions are electromagnetically coupled through a dielectric layer.

12. The radio frequency circuit as recited in claim 10 wherein the electromagnetically coupled surfaces of each of the plurality of strip conductor portions are electromagnetically coupled through air.

13. A radio frequency circuit comprising:

a substrate;

a ground plane conductor disposed on a first surface of said substrate;

a pair of dielectrically spaced strip conductors disposed over a second surface of said substrate, each one of said strip conductors having a plurality of first portions with lower surfaces spaced a first predetermined distance from the ground plane conductor, and a plurality of second portions with lower surfaces spaced a second different predetermined distance from the ground plane conductor.

14. The radio frequency circuit as recited in claim 13 wherein end portions of each pair of strip conductors are interlaced.

15. The radio frequency circuit as recited in claim 13 wherein intermediate portions of each pair of strip conductors are interlaced.

16. The radio frequency circuit as recited in claim 13 wherein each one of the pair of strip conductors is spaced substantially the same average predetermined distance from the ground plane conductor.

17. The radio frequency circuit as recited in claim 13 wherein the pair of strip conductors are electromagnetically coupled.

18. A radio frequency circuit comprising:

a ground plane;

a first pair of dielectrically spaced strip conductors disposed in a first plane over said ground plane;

a second pair of dielectrically spaced strip conductors disposed in a second different plane over said ground plane and dielectrically spaced from such first pair of dielectrically spaced strip conductors; and means for electromagnetically coupling a first surface of each one of the first pair of strip conductors to a second surface opposite the first surface of an axially aligned one of the second pair of strip conductors.

19. A radio frequency circuit comprising:

a pair of electromagnetically coupled strip conductors, each one of the strip conductors having first and second lower portions dielectrically spaced at different distances from a ground plane conductor.

20. A radio frequency circuit comprising:

a first strip conductor having top and bottom surface portions;

a second strip conductor having top and bottom surface portions; and means, including such top and bottom surface portions of each one of such strip conductors, for coupling energy between said first and second strip conductors.

21. A radio frequency circuit comprising:

a substrate;

a first plurality of spaced strip conductor segments disposed over a surface of said substrate;

a second plurality of spaced strip conductor segments dielectrically spaced over said first plurality of spaced strip conductor segments and disposed over said surface of the substrate; and means for selectively interconnecting said first strip conductor segments and said second strip conductor segments to provide a pair of spaced, interlaced strip conductors.

* * * * *